US011904221B2

(12) United States Patent
Nee

(10) Patent No.: US 11,904,221 B2
(45) Date of Patent: Feb. 20, 2024

(54) FOOTBALL SNAP RECEIVING TRAINING DEVICE AND METHOD OF USE

(71) Applicant: John Nee, Gahanna, OH (US)

(72) Inventor: John Nee, Gahanna, OH (US)

( * ) Notice: Subject to any disclaimer, the term of this patent is extended or adjusted under 35 U.S.C. 154(b) by 0 days.

(21) Appl. No.: 17/860,463

(22) Filed: Jul. 8, 2022

(65) Prior Publication Data

US 2024/0009543 A1 Jan. 11, 2024

(51) Int. Cl.
*A63B 69/40* (2006.01)
*A63B 69/00* (2006.01)

(52) U.S. Cl.
CPC ..... *A63B 69/408* (2013.01); *A63B 69/002* (2013.01); *A63B 69/0073* (2013.01); *A63B 69/40* (2013.01); *A63B 2243/007* (2013.01)

(58) Field of Classification Search
CPC ..... A63B 69/40; A63B 69/407; A63B 69/408; A63B 69/002; A63B 69/0073; A63B 69/0075; A63B 2243/007
USPC ..... 124/4, 6, 7
See application file for complete search history.

(56) References Cited

U.S. PATENT DOCUMENTS 2,767,985 A * 10/1956 Maxcey, Jr. ..... A63B 69/40 124/36
3,399,892 A * 9/1968 Jurkiewicz ..... A63B 69/408 473/438
3,612,027 A * 10/1971 Makino ..... A63B 69/40 124/16
3,700,238 A * 10/1972 Mathis ..... A63B 71/0686 473/438
4,271,813 A * 6/1981 Rowe ..... A63B 69/408 124/34
4,906,001 A * 3/1990 Vaughn ..... A63B 69/408 124/36
6,045,464 A 4/2000 Crist, Jr.
6,050,906 A * 4/2000 Stout ..... A63B 69/002 473/438
6,575,852 B2 * 6/2003 Orner ..... A63B 69/407 482/84
6,718,961 B1 4/2004 Woods
7,125,349 B2 * 10/2006 Tucker ..... A63B 69/408 473/422
D656,208 S 3/2012 Warner
8,460,130 B1 * 6/2013 Earle ..... A63B 69/002 473/422
10,265,598 B1 4/2019 Gague
2006/0030434 A1 * 2/2006 Horkan ..... A63B 69/408 473/438

(Continued)

*Primary Examiner* — John E Simms, Jr.

(57) ABSTRACT

A football snap receiving training device for training a player to receive snaps from center includes a base, which is positionable upon a substantially horizontal surface for a user to stand upon. A bracket is attached to and extends upwardly from the base. A swing arm, which is spring loaded, is rotationally attached to the bracket. A gripping element, which is attached to the swing arm distal from the bracket, selectively grips a football that is positioned on the base. An actuator is attached to the base and is operationally engaged to the gripping element to retain the swing arm in a tensioned configuration. A trigger is attached to the base and is operationally engaged to the actuator. Triggering of the trigger by a foot of the user releases the swing arm, which swings so that the football is snapped to the user.

7 Claims, 5 Drawing Sheets

(56) References Cited

U.S. PATENT DOCUMENTS

| | | | | |
|---|---|---|---|---|
| 2006/0035733 | A1* | 2/2006 | Silver | A63B 69/408<br>473/438 |
| 2008/0090680 | A1* | 4/2008 | Horkan | A63B 69/00<br>473/438 |
| 2013/0109509 | A1* | 5/2013 | Ragen | A63B 69/0075<br>473/420 |
| 2018/0017364 | A1* | 1/2018 | Laporte | F41B 3/03 |
| 2018/0236331 | A1* | 8/2018 | Valencia | A63B 67/06 |
| 2018/0290036 | A1* | 10/2018 | Walker | A63B 47/002 |
| 2019/0224554 | A1 | 7/2019 | West | |

* cited by examiner

FOOTBALL SNAP RECEIVING TRAINING DEVICE AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to football training devices and more particularly pertains to a new football training device for training a player to receive snaps from center. The present invention discloses a football training device for training players to receive snapped footballs.

(2) Description of Related Art Including Information Disclosed Under 37 CFR 1.97 and 1.98

The prior art relates to football training devices, which may comprise snap simulators for training lineman but which do not snap footballs, center snap devices comprising having swinging arms, launch tubes, electrically powered long snap devices, and the like. What is lacking in the prior art is a football training device comprising a spring loaded swing arm attached to a base, wherein the swing arm grips a football and is released by actuating a trigger to snap the football to a player.

(h) BRIEF SUMMARY OF THE INVENTION

An embodiment of the disclosure meets the needs presented above by generally comprising a base, which is configured to be positioned upon a substantially horizontal surface and upon which a user can stand. A bracket is attached to and extends upwardly from the base. A swing arm, which is spring loaded, is rotationally attached to the bracket. A gripping element is attached to the swing arm distal from the bracket and is configured to selectively grip a football that is positioned on the base. An actuator is attached to the base and is operationally engaged to the gripping element to retain the swing arm in a tensioned configuration. A trigger is attached to the base and is operationally engaged to the actuator. The trigger is configured to be triggered by a foot of the user to release the swing arm. The swing arm is configured to swing so that the football is snapped to the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
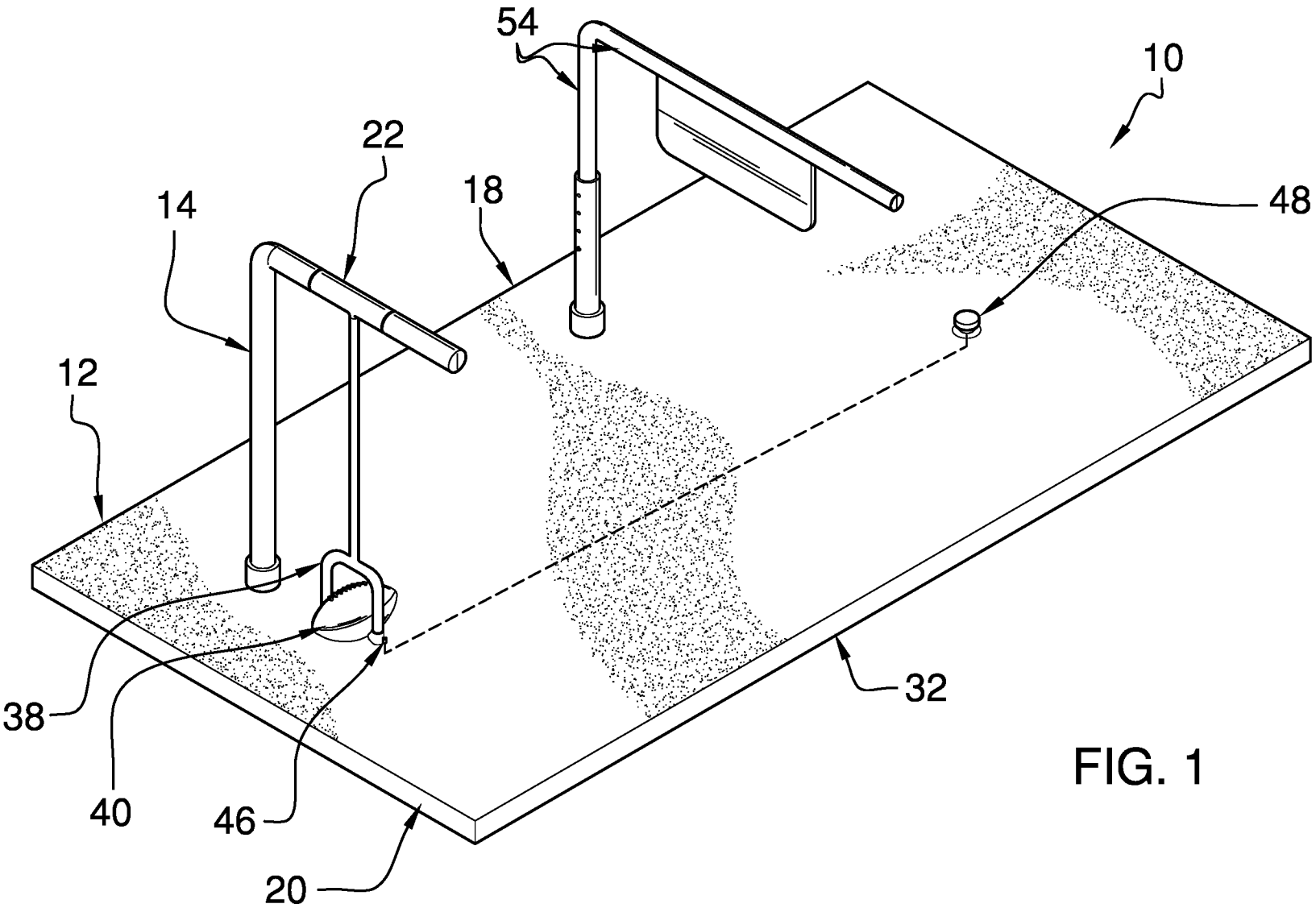
FIG. 1 is an isometric perspective view of a football snap receiving training device according to an embodiment of the disclosure.

With reference now to the drawings, and in particular to FIGS. 1 through 5 thereof, a new football training device embodying the principles and concepts of an embodiment of the disclosure and generally designated by the reference numeral 10 will be described.

As best illustrated in FIGS. 1 through 5, the football snap receiving training device 10 generally comprises a base 12, which is configured to be positioned upon a substantially horizontal surface and upon which a user can stand. As shown in FIG. 1, the base 12 is elongated rectangularly shaped, although the present invention anticipates the base 12 having other shapes, such as, but not limited to, oval, square, and the like.

A bracket 14 is attached to and extends upwardly from the base 12. The bracket 14 may simply comprise a post 16, which is positioned proximate to a first side 18 of the base 12 proximate to a first end 20 of the base 12. The bracket 14 also may comprise A-frames, plates, and the like.

A swing arm 22, which is spring loaded, is rotationally attached to the bracket 14. The swing arm 22 comprises a first rod 24, a second rod 26, a tube 28, and a spring 30. The first rod 24 is attached to the post 16 distal from the base 12 and extends substantially perpendicularly from the post 16 toward a second side 32 of the base 12. The tube 28 is positioned around the first rod 24. The spring 30 is positioned around and attached by a first endpoint 34 to the first rod 24. A second endpoint 36 of the spring 30 is attached to the tube 28. The second rod 26 is attached to and extends from the tube 28.

Figure 2:
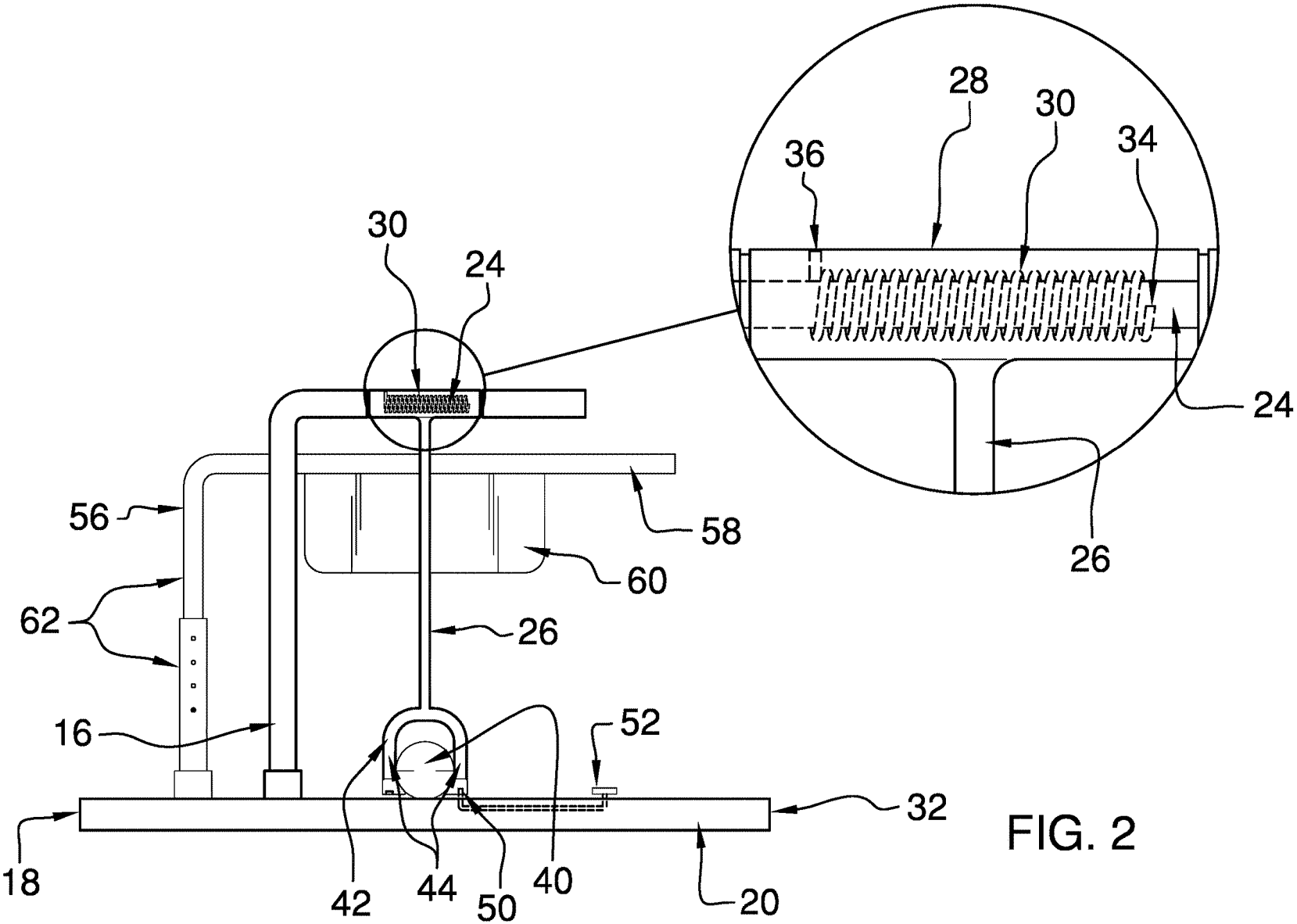
FIG. 2 is a front view of an embodiment of the disclosure.

A gripping element 38 is attached to the swing arm 22 distal from the bracket 14 and is configured to selectively grip a football 40 that is positioned on the base 12. As shown in FIG. 2, the gripping element 38 comprises a U-shaped bar 42. Opposed side elements 44 of the U-shaped bar 42 are configured to frictionally engage the football 40. Other configurations of the gripping element 38 are anticipated by the present invention, such as, but not limited to, releasable clamps, rings, and the like.

Figure 3:
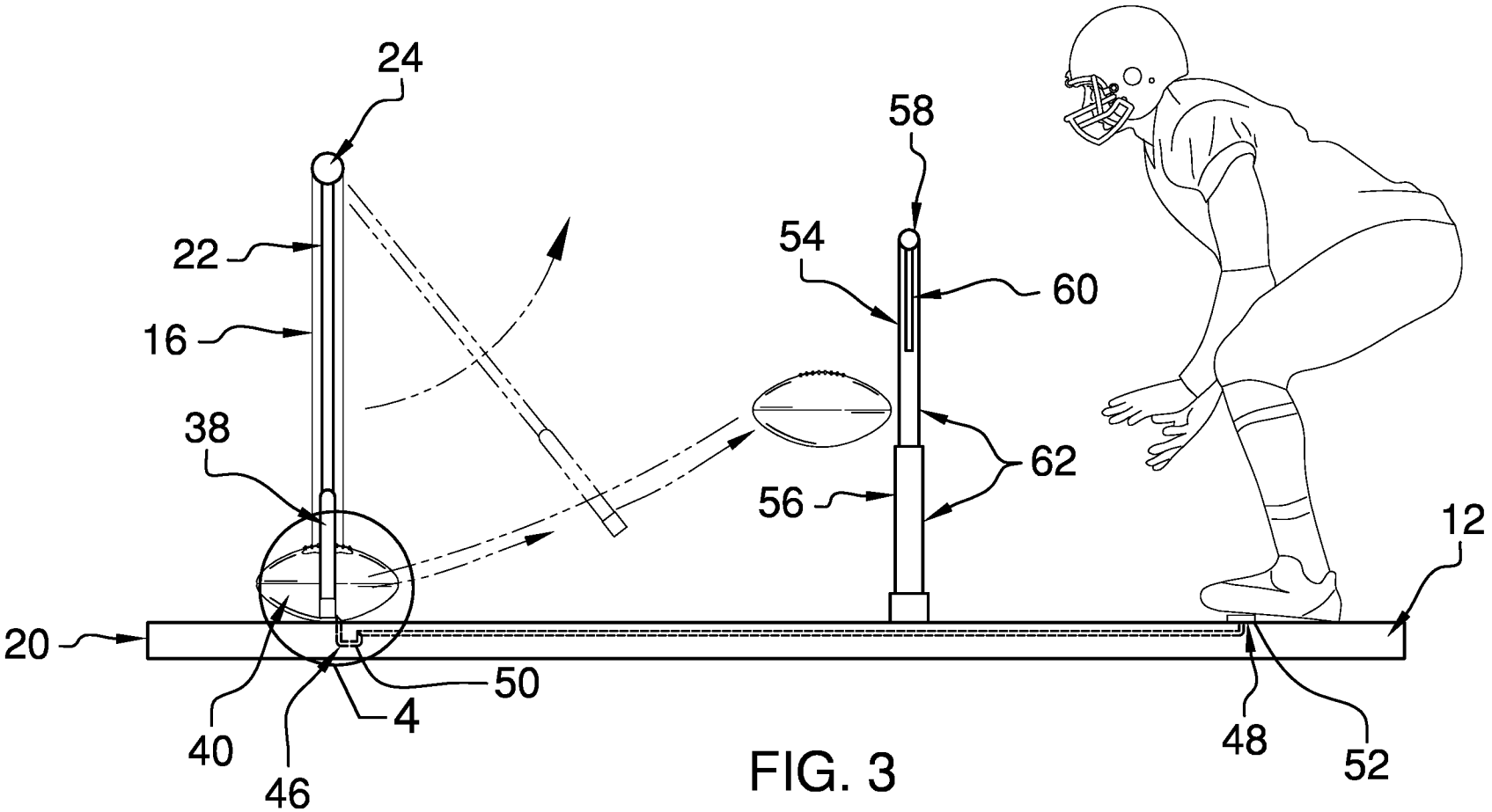
FIG. 3 is an in-use view of an embodiment of the disclosure.

An actuator 46 is attached to the base 12 and is operationally engaged to the gripping element 38 to retain the swing arm 22 in a tensioned configuration, as shown in FIG. 1. A trigger 48 is attached to the base 12 and is operationally engaged to the actuator 46. The trigger 48 is configured to be triggered by a foot of the user to release the swing arm 22, as shown in FIG. 3. The swing arm 22 is configured to swing so that the football 40 is snapped to the user. The present invention is anticipated to be useful in training football players, such as quarterbacks, punters, running backs, and the like, who are called upon to receive snapped footballs 40, particularly long snapped footballs 40 used when a quarterback is receiving a snap while in a shotgun formation.

Figure 4:
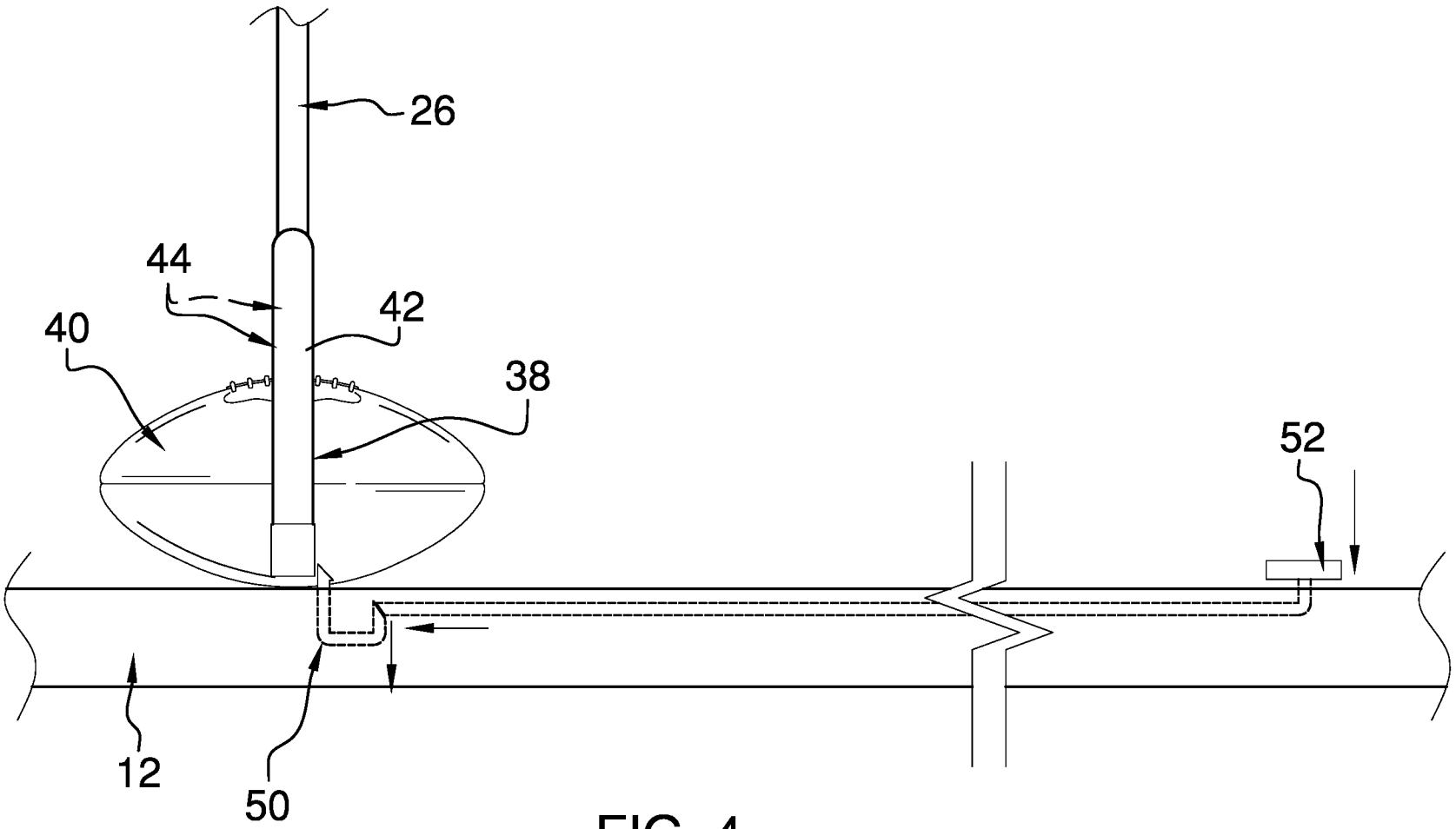
FIG. 4 is a detail view of an embodiment of the disclosure.
Figure 5:
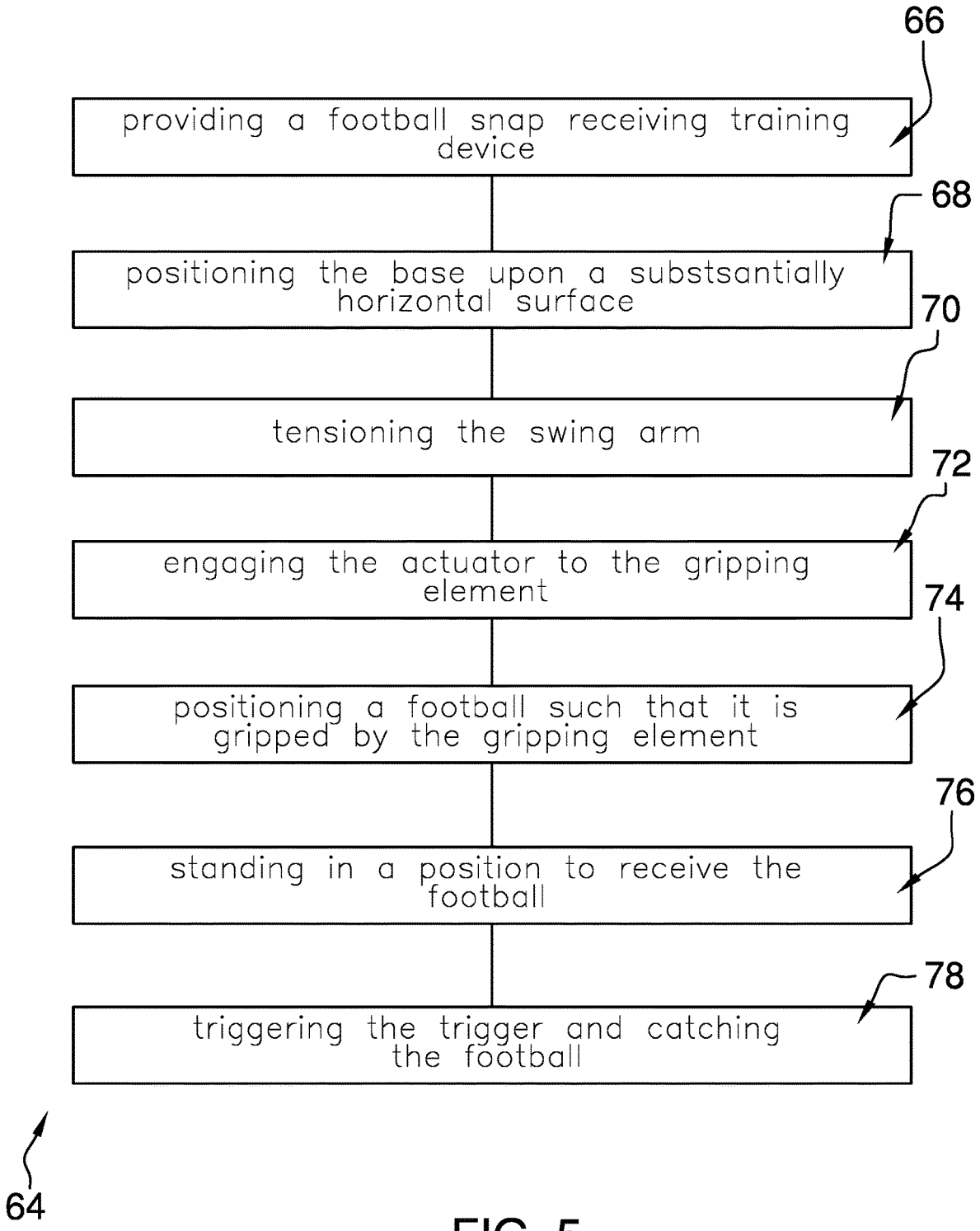
FIG. 5 is a flow diagram for a method utilizing an embodiment of the disclosure.

As shown in FIG. 4, the actuator 46 comprises a latch 50, which is selectively extensible from the base 12 so that the latch 50 prevents swinging of the swing arm 22. The trigger 48 comprises a depressible button 52, which is configured to be stepped upon by the foot of the user to retract the latch 50. The present invention anticipates other configurations of the actuator 46 and the trigger 48, such as, but not limited to, linear actuators in wireless communication with plunger switches, and the like. The present invention also anticipates multiples triggers 48 positioned at different locations on the base 12 to allow for practicing of snap receiving from these positions, such as from under center.

The football snap receiving training device 10 also may comprise a guide arm 54, which is attached to and which extends from the base 12. The guide arm 54 is positioned between the swing arm 22 and the trigger 48, proximate to the first side 18 of the base 12. The guide arm 54 is configured to indicate proper positioning of hands of the user for receiving the football 40, as shown in FIG. 3.

The guide arm 54 comprises a first piece 56, a second piece 58, and a plate 60. The first piece 56 is attached to and extends substantially perpendicularly from the base 12. The first piece 56 comprises a plurality of nested sections 62 so that the first piece 56 is selectively extensible. The first piece 56 being selectively extensible allows the guide arm 54 to be adjusted for players of varying heights. The second piece 58 is attached to the first piece 56 distal from the base 12 and extends substantially perpendicularly from the first piece 56 toward the second side 32 of the base 12. The plate 60 is hingedly attached to the second piece 58.

The football snap receiving training device 10 enables method of training a football player to receive a snapped football 64. The method 64 comprises a first step 66 of providing a football snap receiving training device 10 according to the specification above. A second step 68 of the method 64 is positioning the base 12 upon a substantially horizontal surface. A third step 70 of the method 64 is tensioning the swing arm 22. A fourth step 72 of the method 64 is engaging the actuator 46 to the gripping element 38. A fifth step 74 of the method 64 is positioning a football 40 such that it is gripped by the gripping element 38. A sixth step 76 of the method 64 is standing in a position to receive the football 40. A seventh step 78 of the method 64 is triggering the trigger 48 and catching the football 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A football snap receiving training device comprising:

a base configured to be positioned upon a substantially horizontal surface and upon which a user can stand;

a bracket attached to and extending upwardly from the base;

a swing arm rotationally attached to the bracket, the swing arm being spring loaded;

a gripping element attached to the swing arm distal from the bracket and being configured for selectively gripping a football positioned on the base;

an actuator attached to the base and operationally engaged to the gripping element for retaining the swing arm in a tensioned configuration;

a trigger attached to the base and operationally engaged to the actuator, wherein the trigger is configured for being triggered by a foot of the user for releasing the swing arm, wherein the swing arm is configured for swinging, such that the football is snapped to the user;

a guide arm attached to and extending from the base, the guide arm being positioned between the swing arm and the trigger proximate to a first side of the base, wherein the guide arm is configured for indicating proper positioning of hands of the user for receiving the football; and wherein the guide arm comprises:

a first piece attached to and extending substantially perpendicularly from the base, the first piece comprising a plurality of nested sections, such that the first piece is selectively extensible;

a second piece attached to the first piece distal from the base, and extending substantial perpendicularly from the first piece toward a second side of the base; and a plate hingedly attached to the second piece.

2. The football snap receiving training device of claim 1, wherein the base is elongated rectangularly shaped.

3. The football snap receiving training device of claim 1, wherein the bracket comprises a post positioned proximate to a first side of the base proximate to a first end of the base.

4. The football snap receiving training device of claim 3, wherein the swing arm comprises:

a first rod attached to the post distal from the base and extending substantially perpendicularly from the post toward a second side of the base;

a tube positioned around the first rod;

a spring positioned around and attached by a first endpoint to the first rod, a second endpoint of the spring being attached to the tube; and a second rod attached to and extending from the tube.

5. The football snap receiving training device of claim 1, wherein the gripping element comprises a U-shaped bar, wherein opposed side elements of the U-shaped bar are configured for frictionally engaging the football.

6. The football snap receiving training device of claim 1, wherein:

the actuator comprises a latch, the latch being selectively extensible from the base, such that the latch prevents swinging of the swing arm; and the trigger comprises a depressible button, wherein the depressible button is configured for being stepped upon by the foot of the user for retracting the latch.

7. A football snap receiving training device comprising:

a base configured to be positioned upon a substantially horizontal surface and upon which a user can stand, the base being elongated rectangularly shaped;

a bracket attached to and extending upwardly from the base, the bracket comprising a post positioned proximate to a first side of the base proximate to a first end of the base;

a swing arm rotationally attached to the bracket, the swing arm being spring loaded, the swing arm comprising:

a first rod attached to the post distal from the base and extending substantially perpendicularly from the post toward a second side of the base, a tube positioned around the first rod, a spring positioned around and attached by a first endpoint to the first rod, a second endpoint of the spring being attached to the tube, and a second rod attached to and extending from the tube;

a gripping element attached to the swing arm distal from the bracket and being configured for selectively gripping a football positioned on the base, the gripping element comprising a U-shaped bar, wherein opposed side elements of the U-shaped bar are configured for frictionally engaging the football;

an actuator attached to the base and operationally engaged to the gripping element for retaining the swing arm in a tensioned configuration, the actuator comprising a latch, the latch being selectively extensible from the base, such that the latch prevents swinging of the swing arm;

a trigger attached to the base and operationally engaged to the actuator, wherein the trigger is configured for being triggered by a foot of the user for releasing the swing arm, wherein the swing arm is configured for swinging, such that the football is snapped to the user, the trigger comprising a depressible button, wherein the depressible button is configured for being stepped upon by the foot of the user for retracting the latch; and a guide arm attached to and extending from the base, the guide arm being positioned between the swing arm and the trigger proximate to the first side of the base, wherein the guide arm is configured for indicating proper positioning of hands of the user for receiving the football, the guide arm comprising:

a first piece attached to and extending substantially perpendicularly from the base, the first piece comprising a plurality of nested sections, such that the first piece is selectively extensible, a second piece attached to the first piece distal from the base, and extending substantially perpendicularly from the first piece toward the second side of the base, and a plate hingedly attached to the second piece.

* * * * *